US006106439A

United States Patent [19]

Boland

[11] Patent Number: 6,106,439

[45] Date of Patent: Aug. 22, 2000

[54] COMBINATION FOOT STEPPER AND BENCH PRESS DEVICE

[76] Inventor: Kevin O'Brien Boland, 5623 Massachusetts Ave., Bethesda, Md. 20816

[21] Appl. No.: 09/245,903

[22] Filed: Feb. 8, 1999

Related U.S. Application Data

[63] Continuation of application No. 09/103,700, Jun. 24, 1998, abandoned

[60] Provisional application No. 60/050,730, Jun. 25, 1997.

[51] Int. Cl.[7] ..... A63B 21/00

[52] U.S. Cl. ..... 482/51; 52/142

[58] Field of Search ..... 482/52, 57, 51, 482/112, 54, 53, 58, 70, 140

[56] References Cited

U.S. PATENT DOCUMENTS

| | | | |
|---|---|---|---|
| 5,007,631 | 4/1991 | Wang | 482/52 |
| 5,411,454 | 5/1995 | Chang | 482/57 |
| 5,480,365 | 1/1996 | Lundin et al. | 482/57 |
| 5,562,574 | 10/1996 | Miller | 482/57 |
| 5,571,063 | 11/1996 | Ivanov | 482/57 |
| 5,626,539 | 5/1997 | Piaget | 482/52 |

*Primary Examiner*—Jerome Donnelly
*Attorney, Agent, or Firm*—A. R. Eglington

[57] ABSTRACT

A dual-purpose exercise machine, adapted to alternately condition two different sets of muscles, one device mode being for the legs and buttocks muscle sets (the foot stepper mode), and the other device position being for the pectoral/chest muscles and the upper arm muscles (biceps/triceps) in the bench press and ring extension modes. In the stepper mode, the device resembles a conventional stepping machine, having an upstanding vertical mast, conveniently formed by parallel elongate rigid members, set with a transverse span. A planar platform is securely mounted within the frame of the mast. An opposing pair of manual exertion resistance means, conveniently of hydraulic dampers, are disposed substantially horizontal, linked to the lever arms. They are mechanically linked to provide the variable resistance in opposition to alternating depression by user exerted upon foot-step platforms. When the platform component is inverted to lie in the bench press mode, the end spanning member forms the distal longitudinal end of the platform. A pair of transversely mounted gripping bar, which is vital to use of the machine, when it is in the bench press mode, are located on the lever arms ends.

14 Claims, 13 Drawing Sheets

FIG. 15
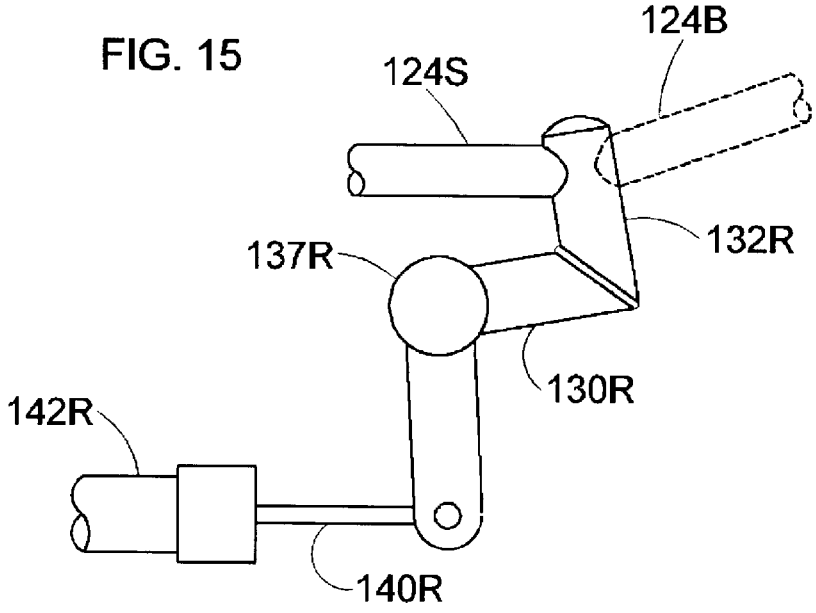
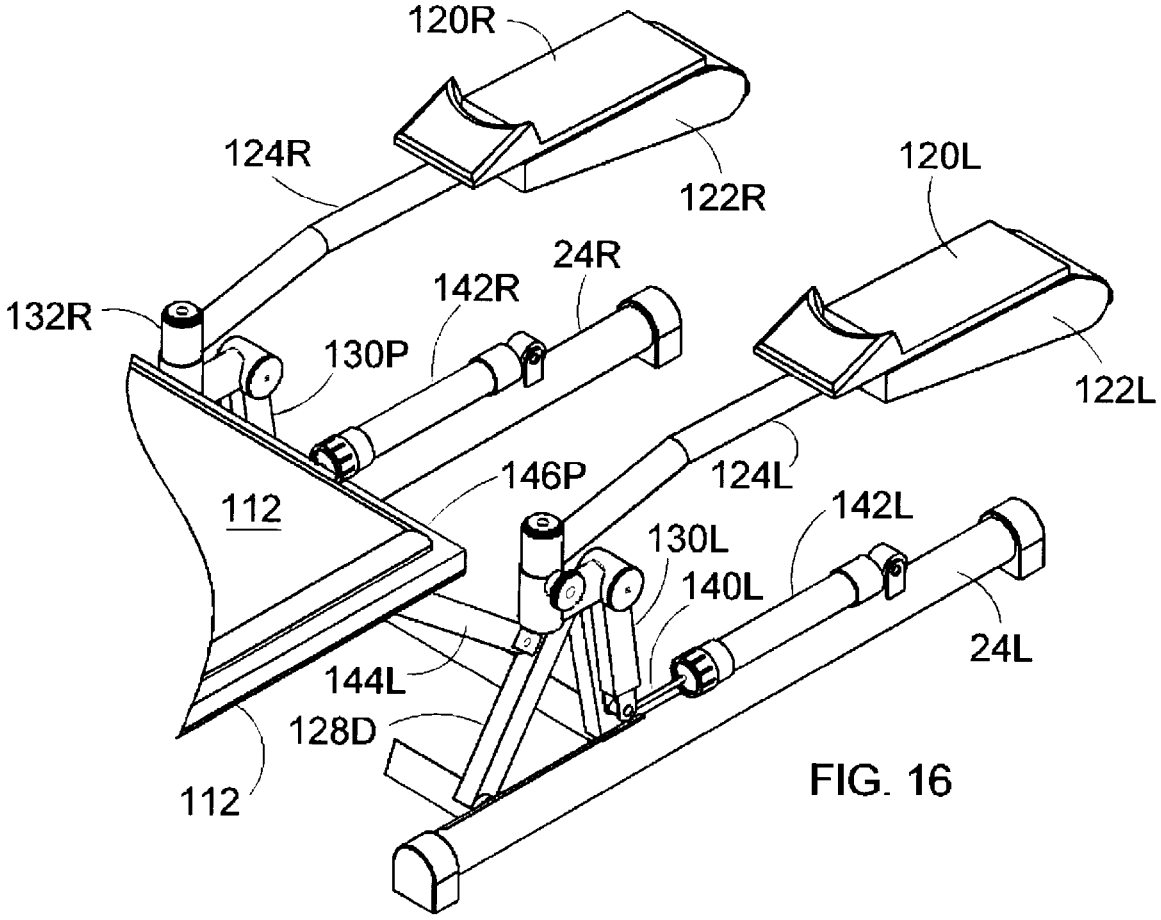
FIG. 16

COMBINATION FOOT STEPPER AND BENCH PRESS DEVICE

CROSS REFERENCE TO OTHER APPLICATIONS

This is a regular patent application submitted for an official filing receipt under 35 U.S. Code §111(a). It also relates to U.S. Disclosure Document No. 424,778, filed Oct. 6, 1997, titled "Combination Stepper and Bench Press Machine,"; also to U.S. Disclosure Document No. 419,364, filed May 28, 1997, also titled "Combination Stepper and Bench Press Machine," and claims benefit of provisional patent application, (same title), granted Ser. No. 60/050,730, filed Jun. 25, 1997, and is a continuation of patent application (same title) granted Ser. No. 09/103,700, filed Jun. 24, 1998 now abandoned.

FIELD OF THE INVENTION

The present invention relates to a readily movable convertible device adapted for selective human muscle conditioning and development.

BACKGROUND OF THE INVENTION

The need for practical and affordable devices suitable for muscular toning and body conditioning is a long established one. There are a large variety of exercise devices, many of which focus on conditioning one set of muscles, and a few of which are adaptable to toning of two related sets of muscles, for example, biceps and triceps. Traditionally, a foot stepping device and a bench press device are discrete exercise platforms. Heretofore, no one has disclosed a practical device that can be effectively combined into a stepping exercise and a vertical bench press exercise, both being molded into the one machine, using only one set of steps/arms linked to one set of resistance means such as fluid-filled hydraulic cylinders. Nor has anyone disclosed an optional pair of hand grippable, D-rings for conducting a number of arm and torso exercises.

It is a principal object of the present invention to provide a single portable device that has alternate modes of operation, one being for aerobic stepping exercises, and the other mode being for the familiar bench press strengthening exercise; and also for arm extension exercises.

Yet another object of the present invention is to provide for an adjustable, inclined (slanted) board when used in the bench press mode, which optimal slant permits use in the stomach muscles strengthening device, the so-called "sit-ups."

Another object of the present invention is to provide a readily modifiable exercise machine which, while aligned in the bench press mode, can be used for vertical bench pressing.

Still another object of the present invention is to provide a combination exercise device, in which the operative lever arms can be handily adjusted to serve either for the vertical lever stepping mode, or alternately, in the vertical bench press mode.

A yet still further object with the inclined bench support is to provide such balance with an adjustable height, collapsible leg on the bench underside for variable incline.

Still another object of the present invention is to provide a dual-role exercise machine that can be folded up for convenience storage when not in use.

SUMMARY OF THE INVENTION

According to the present invention, there is provided a dual-purpose exercise machine, adapted to alternately condition two different sets of muscles, one device mode being for the legs and buttocks muscle sets (the foot stepper mode), and the other device position being for the pectoral/chest muscles and the upper arm muscles (biceps/triceps) in the bench press and ring extension modes.

While in the stepper mode of a schematic FIG. 1, the present device resembles a conventional stepping machine, including the presentation of an upstanding vertical mast, conveniently formed by parallel elongate rigid members, which arms are set with about a ten inch transverse span, and are closed at both longitudinal ends. A planar platform is securely mounted within the frame of the mast. Also, a separable spanning component (generally rectangular) is provided, anchored transversely and aligned angularly at the upper mast end, forming a bracing member to maintain the present gap for user graspability. The grippable, offset, bracing arms are further modified to be enclosed in resilient padding. The added padding facilitates callous-free gripping of the cross arm by the body-rocking user, while being used in the stepping mode of FIG. 2.

Alternatively, when the platform component is inverted to lie in the bench press mode (see FIG. 3), then the padded, transverse end spanning member forms the distal (feet) longitudinal end of the torso-support platform bench. An opposing pair of manual exertion resistance means, conveniently of either hydraulic cylinders called dampers, or pneumatic springs, are disposed substantially horizontal, in both modes. They are mechanically linked to provide the variable resistance needed in opposition to the alternating depression by user being exerted upon the foot-step platforms. This paired set of foot-steps are preferably rotated to incline somewhat closer together, as in the depicted step mode of FIG. 1, due to variable human anatomy (degree of functional leg spread). Lastly, the foot-step platforms are each provided with an integral underside recess having vertical sidewalls. This open recess supports between the sidewalls, a short, transversely mounted gripping bar, which is vital to use of the machine, when it is in the bench press mode, now to be described.

In the bench press mode of the perspective view of FIG. 3, the parallel, frame of the "spanning" component have been rotated downwardly so as to contact the floor, using their anchored transverse support component thus providing firm floor support at the distal end for the bench press mode. A padded planar board mounted securely within the elongate frame serves as the torso support. Concurrently, the dual purpose, foot-support platforms now have been are rotated essentially 180°, to now project horizontally toward the distal bench end. With this limited lever-end rotation, they now function as hand-grippable components. They are biased via a counter resistance means (dampers) to provide uniform resistance to the user arm exertion while lying in the vertical bench press exercise of FIG. 4. Note that the platform-end members (now being hand grippable) by virtue of shallow angle in the lever arms, are positioned further apart laterally and transversely while they are disposed in the bench press mode. This is to compensate for the somewhat wider gap normally needed between the spread arms of the user, as compared to the limited lateral leg spread of a stepping user in FIG. 2.

For the vertical bench press exercises, the paired hydraulic cylinders are still operatively connected by their piston rods to the other longitudinal end of pivotable vertical members, so to provide the resistance to the prone user's muscular exertions against the gripped under-platform short bars.

As depicted in FIG. 2, the transverse support bar for the upper platform arms, and the underslung hydraulic pistons, each have alternate intermediate pivot points, facilitating the conversion of the operative lever members from one operative mode to the other.

SUMMARY OF FIGURES

FIG. 15 is a broken out, enlarged side elevation view of the device mode of FIG. 13 depicting the mechanical linkage between the foot stepping levers and the counter tensioning means provided by the depicted biasing means, oriented to control device action while configured and operating in the feet stepping mode of FIG. 13, and FIG. 16 is a broken away, enlarged perspective view being a precursor of the device mode of FIG. 14, depicting the L-shaped member linkage means, interposed between the bench press levers and the counter tension provided by the depicted biasing means, oriented to control device action, while still configured partly in the foot stepping mode, now ready for support arms rotation to the bench pressing mode;

DETAILED DESCRIPTION OF A PREFERRED EMBODIMENT

Figure 1:
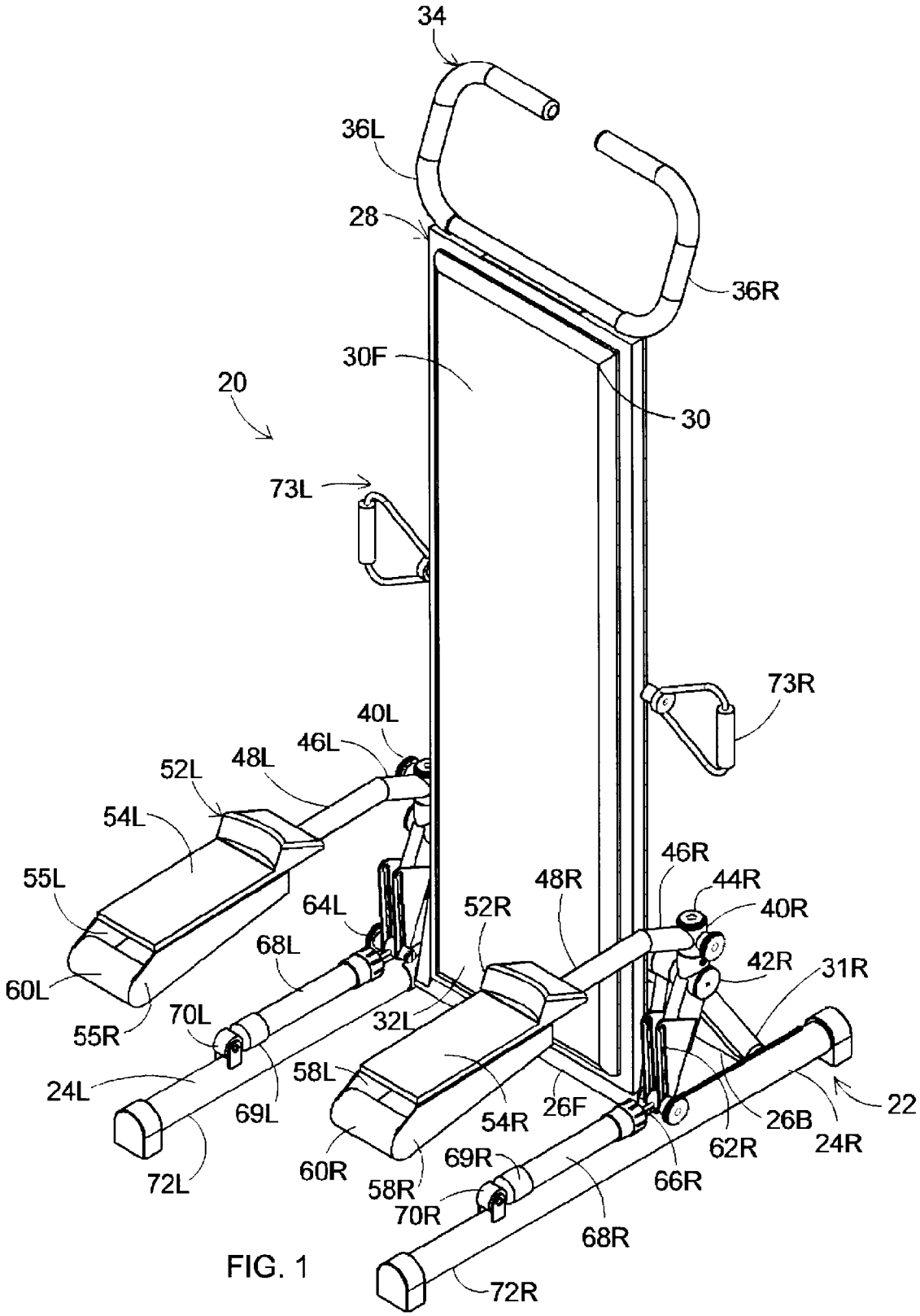
FIG. 1 is a perspective view of the present device, oriented in the feet stepping mode, depicting the at rest, but operable, positions for the feet platform components mounted on the free ends of the lever arms.
Figure 4:
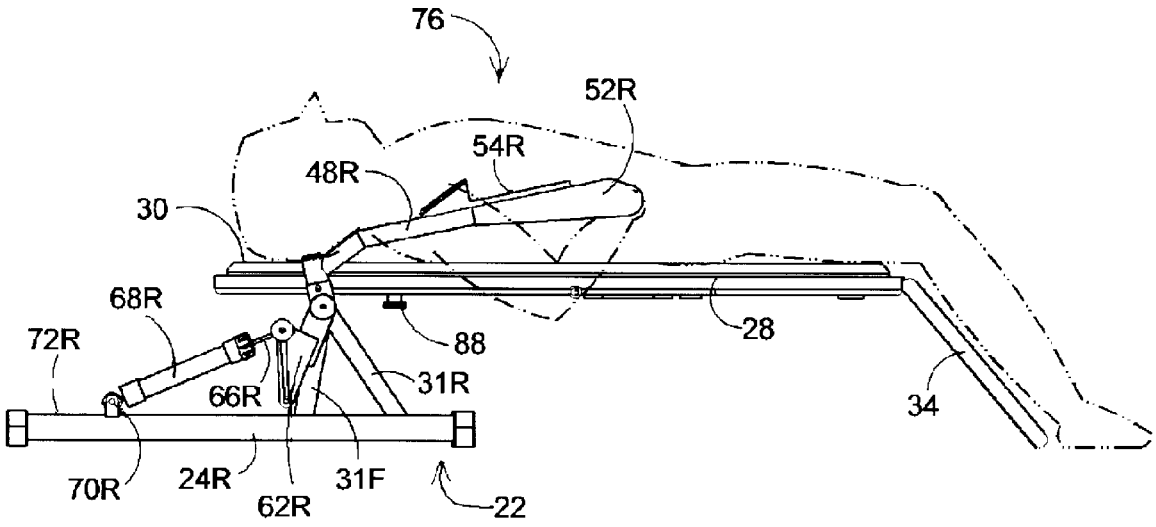
FIG. 4 is a side elevational view of the device of FIG. 3, showing a male exerciser (in phantom) employing the bench press device, by exerting force on the lever arm ends gripping bars against the operably-tied piston rods, through its associated resistance linkage.

Referring now to the drawing, and to FIG. 1 in particular, the inventive device 20 is depicted in the at-rest mode for the foot stepping exercise, to be described. The floor-stationary component 22 comprises a spaced-apart, substantially parallel, pair of rigid elongate linear members 24L/24R, usually composed of tubular steel for lightness, which parallel members are maintained apart by a shorter first pair of spaced-apart, substantially parallel, rigid linear members 26F/26B. An elongate, rigid rectangular frame 28 is vertically and aligned upstanding in this exercise mode. It has a preferably padded, planar platform component 30, seated securly within the elongate frame 28, which planar component will provide the user with a torso support means, while he is using same in the alternate mode of operation (FIG. 4). Proximal to the lower longitudinal end 32L of elongate frame 28 is affixed permanently to the axially-aligned pivot member 29R supported on triangular sidewalls 31R of the floor frame. A like pivot member 29L is supported on opposing sidewall 31L, supports the other edge of frame 28.

Figure 3:
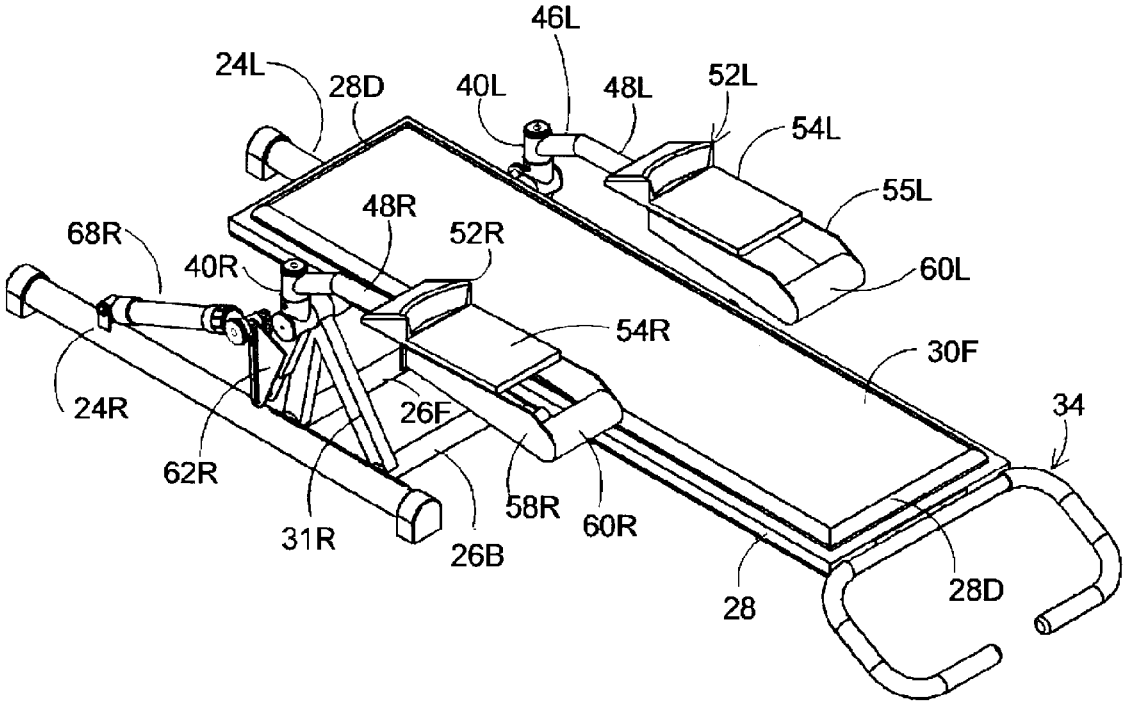
FIG. 3 is another perspective view of the present device, but now configured in the bench pressing mode, at rest, depicting the gripping portions of the platformed fixture on the lever arm ends, now rotated horizontally toward the distal platform end, to be suitable for manual gripping and vertical lifting by the user.

Paired projections, 29L/R, serve as the pivotable transverse support for the proximal end of rotatable elongate frame member 28, which can be moved arcuately from the depicted vertical position to reach the position depicted in FIG. 3 (the bench press mode).

Anchored permanently across the upper longitudinal end of elongate frame 28 is a rigid, rectangular, open frame member 34, disposed at a somewhat obtuse angle relative to the planar frame 28, so as to project outwardly and upwardly from the platform side 30F of the mast device 30 itself. The shorter side members, 36L/36R, of end frame member 34 provide hand grippable points for the rocking user (not seen), while the user is in the foot stepping, body shifting mode, of FIG. 2.

A pair of substantially shorter, upright posts, 40L/40R, are located, spaced apart, and mounted on proximal the outer ends of pivotable members 29L/R. Each upright member (40L/40R) is configured to rotate in a vertical plane about its supporting pivotable members 29L/R, 42L/R in response to certain operatively linked members, to be described.

Also connected adjacent to the upper longitudinal ends, 44L/44R, of post members 40L/40R, are the inner longitudinal ends, 46L/46R, of a pair of elongate lever members, 48L/48R. Lever members 48L/R are disposed substantially parallel (but pivotable inwardly/outwardly) for achieving a reduced spaced-apart, when positioned in the depicted foot stepping mode.

The free longitudinal ends of lever members, 48L/48R, are each provided with a dual purpose fixture, 52L/R, namely, a platform element having a planar surface area, 54L/R, each sufficient to support a human foot (not seen). Platform elements 52L/R are rotatable horizontally being linked axially to lever members 48L/R. Each platform is preferably composed of a rigid material of construction that permits each fixture 52L/R to also present a depending pair of opposing skirts, with the skirts 55L/R underlying platform 54L, and skirts 58L/R, underlying platform 54R. Spanning each set of opposing skirt sidewalls is a rigid bar, 60L/60R, respectively, mounted fixedly therebetween. These rounded bars provide a hand grippable element, needed for use of the device, while it is located in the alternate operational mode of FIG. 3/4.

Linked operatively to the lower longitudinal ends, 62L/62R, of the vertical posts, 40L/40R, are the free longitudinal ends, 64L/64R, of a piston mechanism, 66L/66R, the rigid rods of which will provide the mechanical counter-resistance means to the alternating downward pressure being exerted on the platform elements, 54L/R, by the feet stepping user.

In this embodiment, the resistance means for each platform comprises a hydraulic-activated cylinder, 68L/R (damper), or a pneumatic spring (not shown). Resistance to the vertical movement of rotatable fixture members 52L/52R, with respect to their supporting lever members 48L/48R, is provided by means of a compartmented viscous fluid contained in resistance cylinders 68L/R. Each cylinder is connected at its free-rod end, 66L/R, to its respective vertical member, 40L/R, via slotted element 62L/R. Each resistance cylinder means is also anchored pivotally at its distal cylinder housing end, 69L/R, to mounting lugs 70L/R, located proximal to the longitudinal ends, 72L/R, of elongate floor members 24L/24R. Mounted intermediate the ends of frame 28 are hand rings, 73L/R, to be described.

Figure 2:
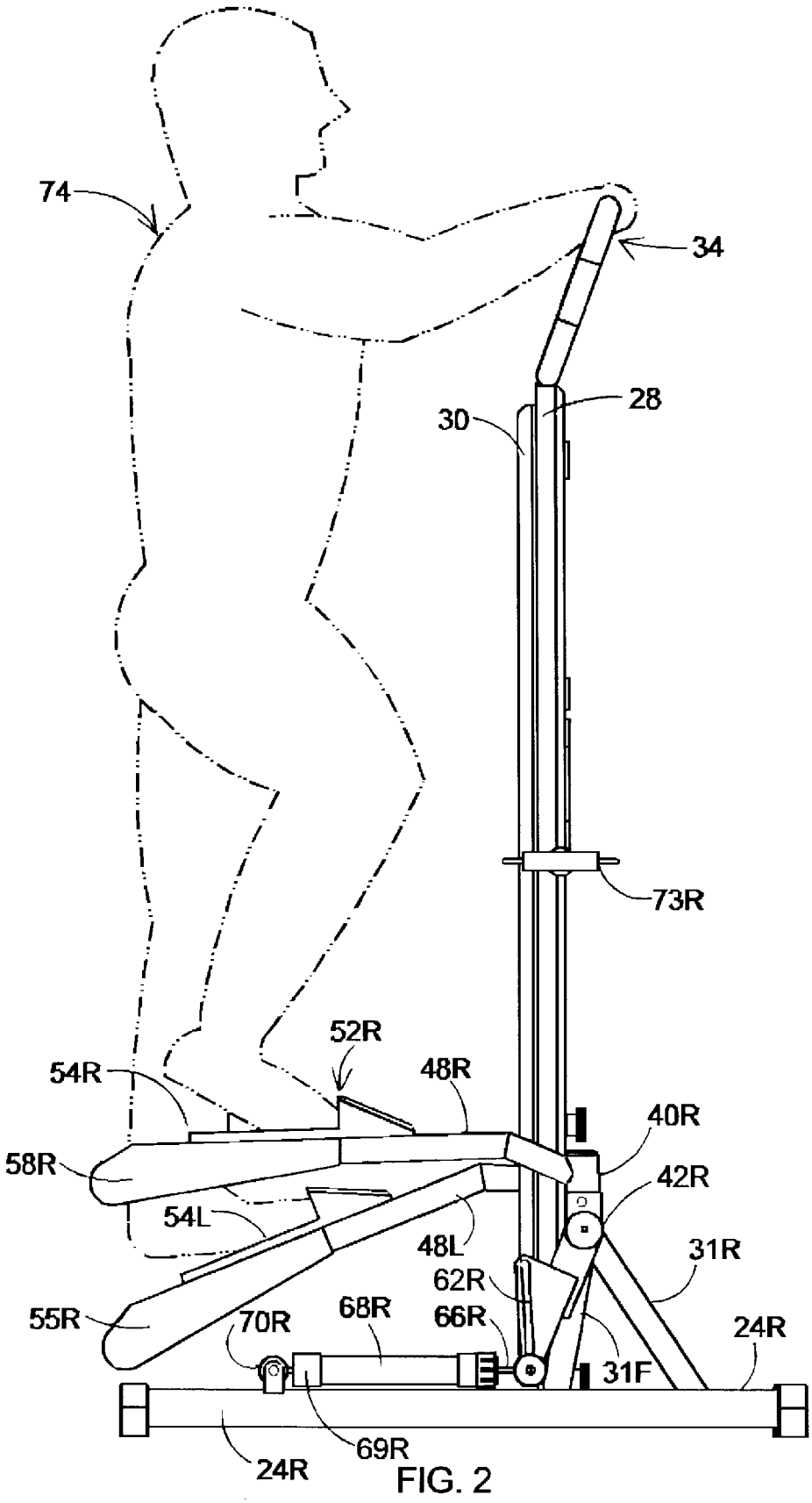
FIG. 2 is a side elevational view of the device of FIG. 1, showing a male exerciser (in phantom) employing the inventive device (Note the vertically spaced-apart (and shifting) positions of the dual stepping-platforms, while operating)

Turning now to the side elevational view of FIG. 2, a human user 74 is depicted engaging the inventive device 20, while positioned in the feet stepping mode. As the user alternately steps down on the levered platforms, 54L/54R, they move vertically and reciprocally, by exerting his leg muscle effort against the resistance provided by the linkages of lever members, 48L/R with pivotable post members 40L/R, sidewall elements 67L/R, and cylinder resistance pistons, 66L/R. Concurrently, the user maintains his balance by grasping the outwardly angled frame member 34 pinned tranversely at the top of elongate frame 28.

Averting now to the other mode of operation of exercise device, which is depicted in FIG. 3 at rest, being seen in the bench pressing mode. The elongate mast frame 28 has been rotated from the vertical position of FIG. 1, to the horizontal position shown, with planar member 30 now serving as a torso support member. The distal transverse frame members, 36L/R, now serve as the ground support means for the distal end 28D of user support bench 30. The proximal (to user) longitudinal end, support 26L/R for the bench is provided through sidewall structures, 31L/R and the floor-resting, H-shaped tubular frame (members 24L/R and cross bars 26F/R) of FIG. 1, generally 22.

One other major positional alteration includes the outward, and arcuate, rotation (essentially 180°), of the parallel lever arms, 48L/48R, to the alternate position shown, namely, by having their platform ends, 54L/54R, now projecting towards the distal end 28D of support bench 30. The mechanical linkage described for the upright end members, 40L/40R, admits of both of them for axial rotation to this operating mode. Their arcuate vertical rotation is in response to the uplifting of the platform ends, 54L/R, upon user lifting effort, such effort being exerted by engaging recessed, gripping cross bars, 60L/60R. The pivoted posts provide in each of the levers, for a greater lateral spread for the parallel lever arms, 48L/48R. This is consistent, with the larger lateral gap presented between human arms, as compared to the gap between human feet. The cross-the-chest lever span is further variable, to fit the anatomy of a specific user, by a modest lateral rotation (inwardly or outwardly) of the lever arms 48L/48R, before starting the uplifting effort.

In the operational side view of FIG. 4, a user 76 is lying located on the bench 30, in the prone position, while grasping the fixture 52L/R via hand bars, 60L/60R (not seen) for upward manipulation. Piston rod 66R is now functionally locked to the upper end of sidewall slot 62R via knob 102 of FIG. 10.

The stationary device support provided by distal open frame 34 and proximal elongate floor frame 22 support elements is clear. As the user exerts upward and concurrent force on the lever members, their respective resistance piston means, 66L/R, acting through the described linkages of FIG. 2, provide the steady damper counterforce throughout the arcuate range of motion of the lever arms fixtures 52L/R. Upon cessation of the user exertion, the unidirectional bias of the resistance means, 66L/R, will return the lever arms to their at rest position of FIG. 3. The view of FIG. 5, functionally related to FIG. 3, lends more clarity to view of the complex linkage, just prior to piston rod 66R resetting within vertical slot 67 to appear as in FIG. 4.

Figure 5:
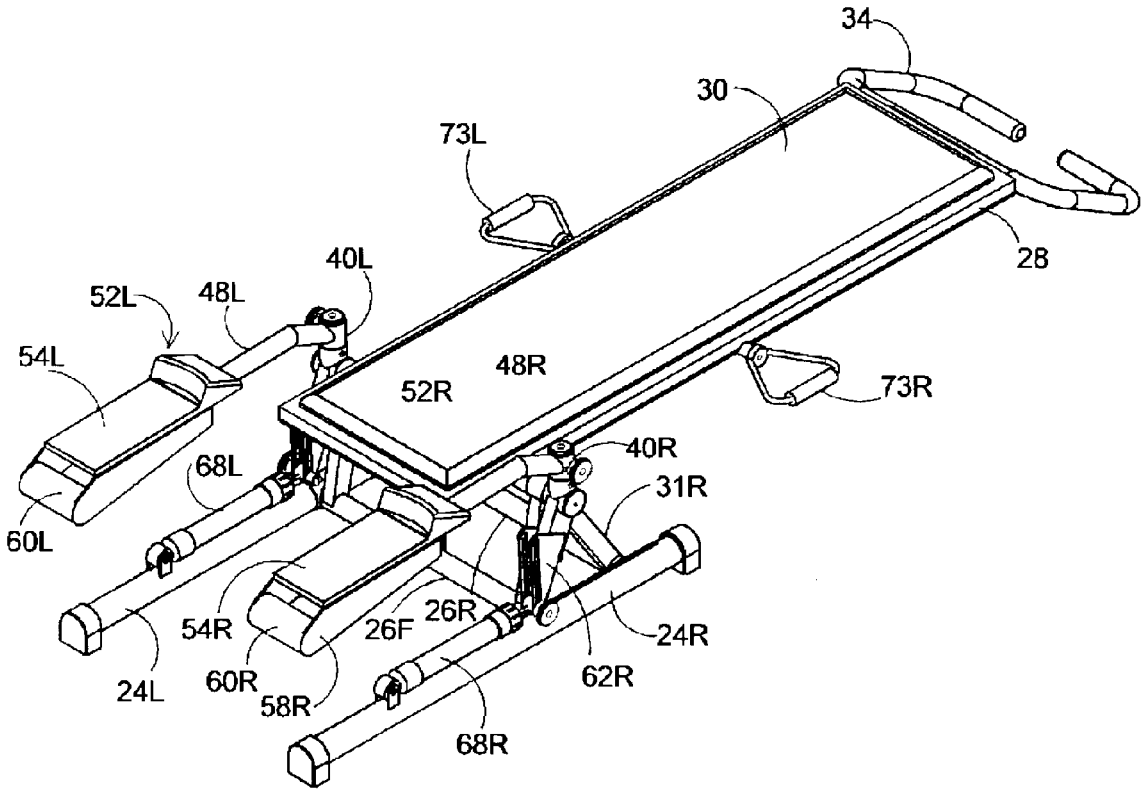
FIG. 5 is another perspective view of the device of FIG. 3, now depicted with an optional, bilateral pair of hand grippable, D-rings mounted in the drawn-in at rest, position.
Figure 6:
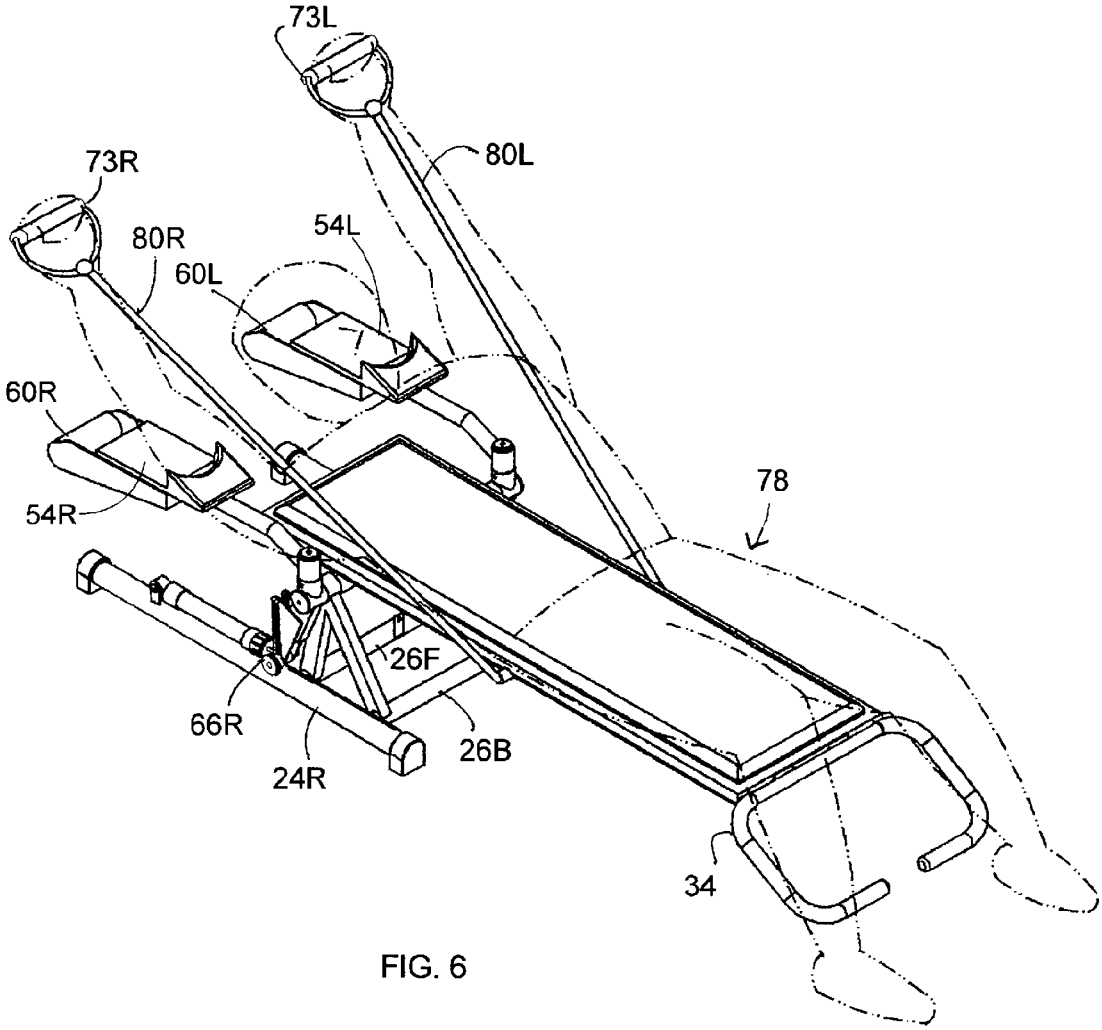
FIG. 6 is another, but converse, perspective view of the device oriented in the bench pressing mode but with the hand grips being extended longitudinally and outwardly, and, FIGS. 7A–F is a composite of a series of perspective views of several exercises for arms and torso muscles, available with the accessory device in the configuration of FIG. 6.
Figure 7A:
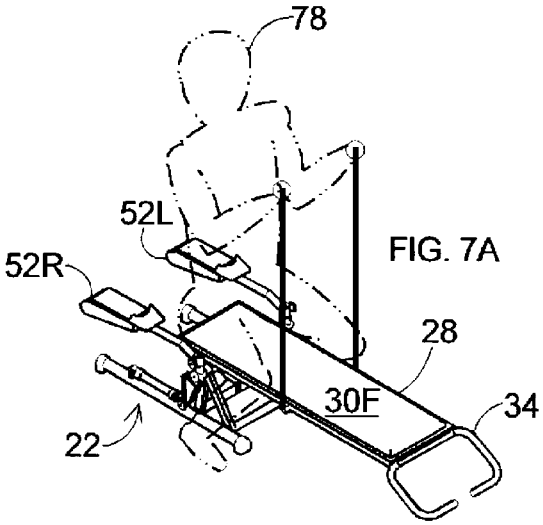
Figure 7D:
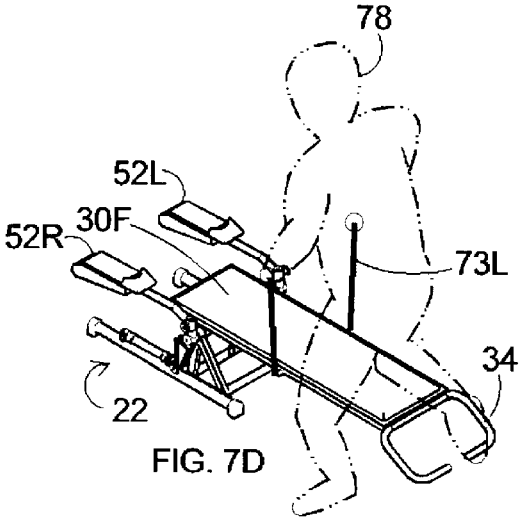
Figure 7B:
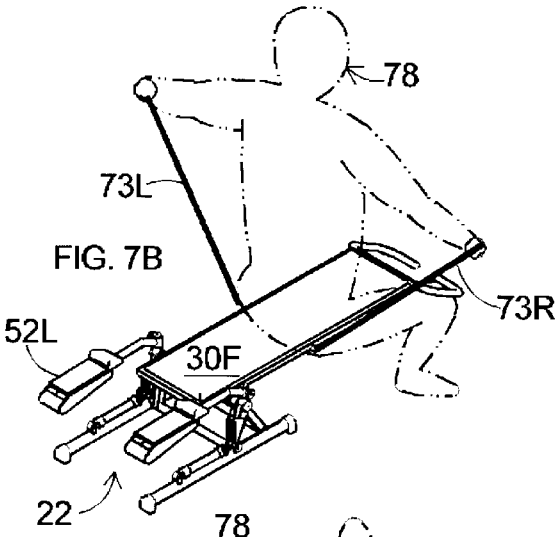
Figure 7E:
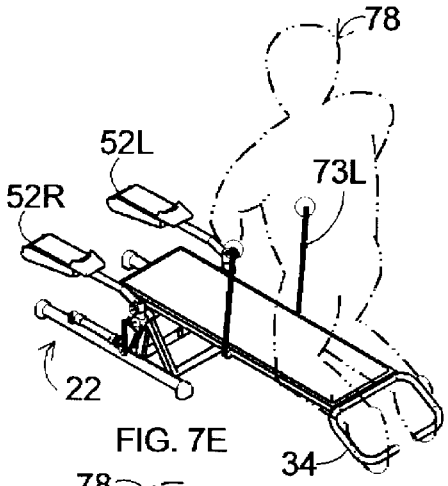
Figure 7C:
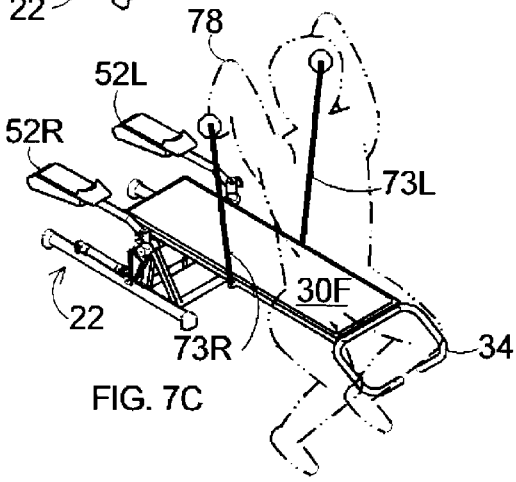
Figure 7F:
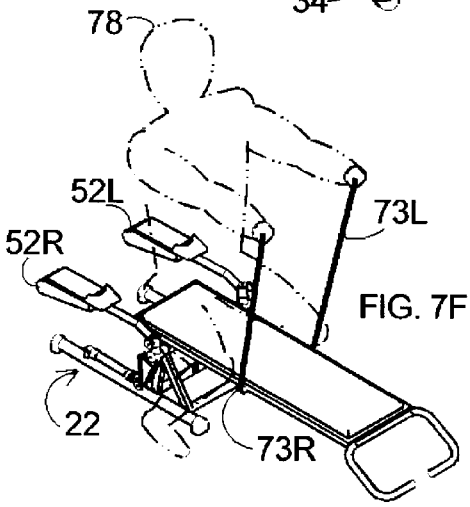

In the perspective view of FIG. 6, the device mode of FIG. 5 is now depicted with a user 78 extending the hand rings 73L/R to one extreme of their range of vertical rotation.

The schematic view of FIG. 7 provides details of a pair of bungee-cord controlled, D-rings pair, 73L/R, mounted intermediate the longitudinal sides of planar platform 30 of the device 20; these D-rings provide for a plurality of exercises, as depicted in FIGS. 7A through 7F (six in all). Represented are: the bicep curl (FIG. 7A); the side lateral raise (FIG. 7B); the tricep extenion (FIG. 7C); the bent-over row (FIG. 7D); the shrug (FIG. 7E); and the front lateral raise (FIG. 7F), all employing the mid-platform, hand-grippable extensible hand rings. The ring user's experiences linearly increasing resistance as the D-rings are drawn away from the at rest position, depicted in FIG. 5. The inherent contractive resilience of the paired bungee cords (not seen), will retract associated ring pair 73L/R to be tucked, unobtrusively, along side frame 28, permitting the other exercises of FIGS. 2, 4, and 6 to be conducted without obstruction.

In the composite view of FIG. 7, some six exercises, not earlier described, are depicted. The forward seated D-ring exercises are: the bicep curl; the side lateral raise; the pull-over; and the front lateral raise. The rear facing exercises are: the bent-over row and the shrug, with the device necessarily aligned in the bench press mode of FIG. 5, except that the lever arms are maintained rotated distally of the torso end of platform 30F. All of these extension rings workouts are conducted with the user either straddling the platform or seated upon same in one of the exercise positions depicted.

Figure 8:
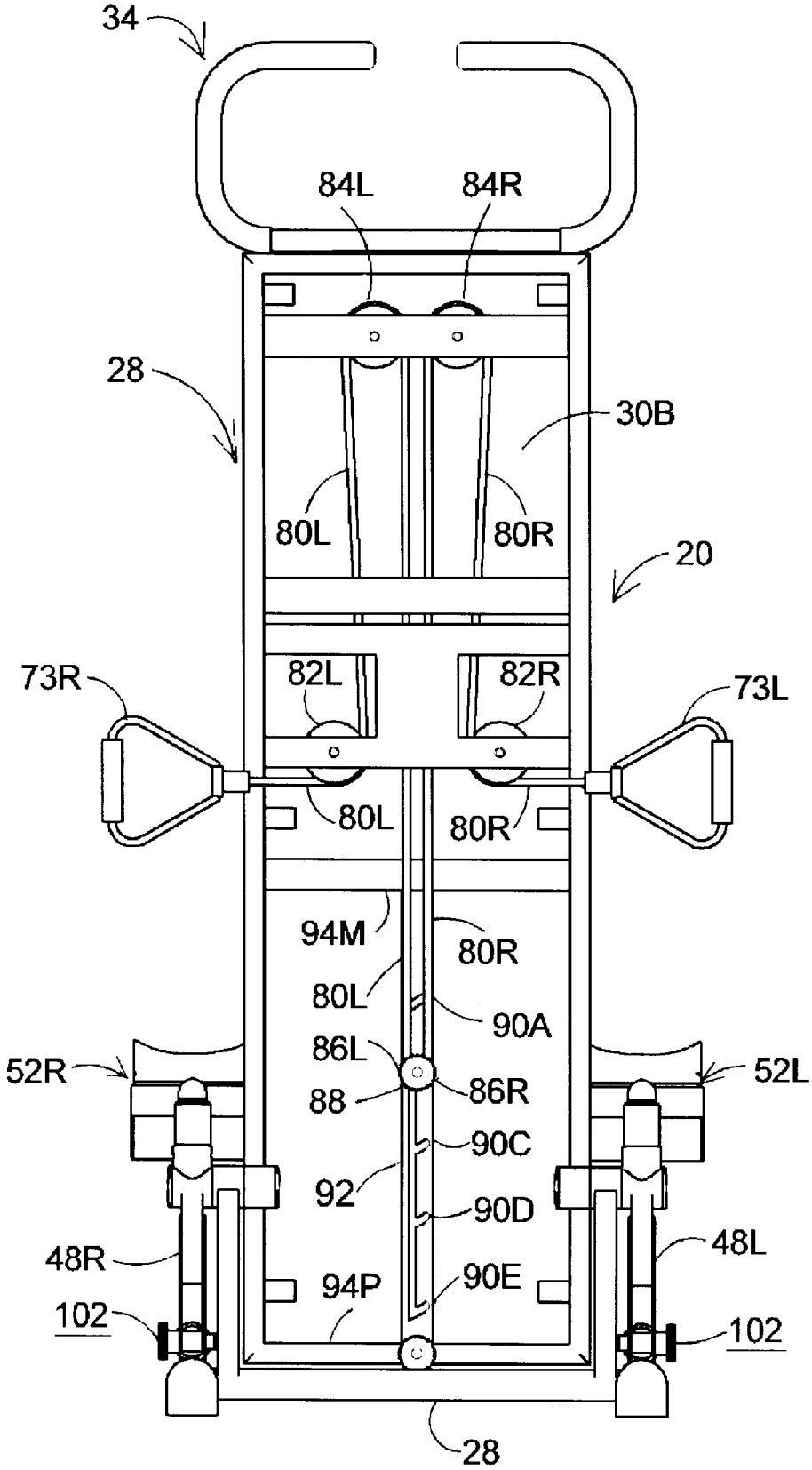
FIG. 8 is a plan view which depicts the obverse side of the vertically-aligned support board of FIG. 1, showing the stringing of the paired bungee cords that support use of the D-rings accessory.

In the elevational view of FIG. 8, showing the obverse surface of the upstanding platform device of FIG. 1, there is depicted the detail of the paired bungee-cords, 80L/R, which provide the tension to lateral sided, rings 73L/R. The rings permit the conduct of the six exercises, schematically depicted in FIGS. 7A–E. The external ends of the bungee cords are securely tied to the apex of the triangular rings 73L/R. Cord 80L is threaded about a midline mounted pulley 82L, then runs longitudinally to and around distal end pulley 84L, returns lengthwise beneath the length of the elongate platform 30 to engage, at its longitudinal end 86L, a retaining plate (not seen), the position of which plate is set by superimposed, locking knob 88. An axial pin (not seen) of knob 88 is inserted into one of the side hooks, 90-B, provided in the centrally aligned, linear member 92, which is provided with a channel shaped cross section. Channel member 92 is pinned at each of its longitudinal ends to underframe transverse members, 94M and 94P, respectively. The lower the lock-in place position of knob 88 along member 92, then the greater the stretching tension that is conferred upon the gripping rings, 73L/R. The ring exercises are necessarily conducted while the device 20 is located in the horizontal mode of FIG. 5. The multi-position stretches for the paired rings provides a wide range of tensions for users of varying arm strength. This one ancillary feature provides for any one of the six hand-involved exercises of FIG. 7, and one of FIG. 6.

Figure 9:
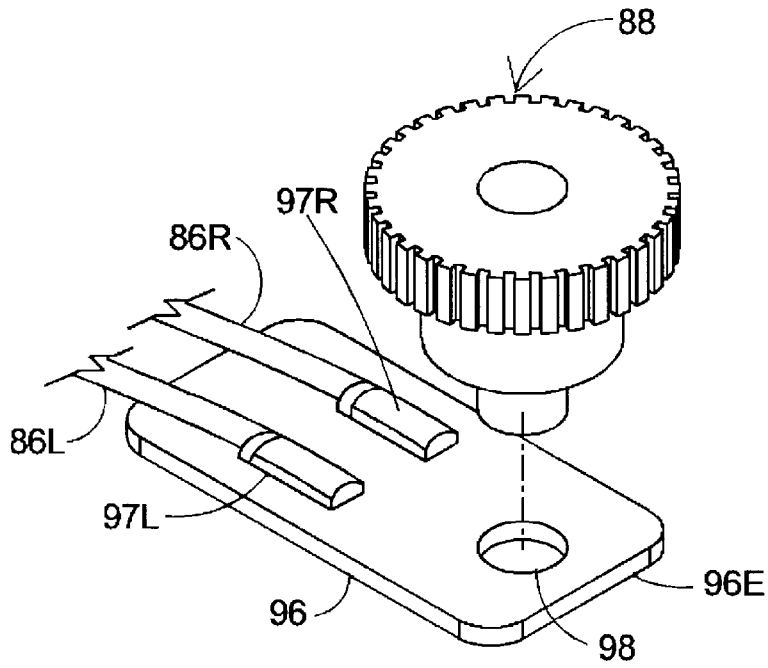
FIG. 9 is an enlarged perspective view of the platform underside knobbed pin offset from the anchored free ends of the paired bungee cords, which serves to retain the degree of tension for the opposing longitudinal end, associated D-rings, to be preset by the assembly of FIG. 8.

The broken out perspective view of FIG. 9 shows how the paired cords, 86L/R, are conventionally pinned to rectangular plate 96, via cleats 97L/R, which plate is sized to slidingly engage lengthwise of channeled member 92 (FIG. 8). Anchoring member 96 is provided with a bore hole 98 proximal to its outer transverse edge 96E, which bore admits of the shaft 88P of the knob and which shaft engages one of the plural key slots, 90A–E, provided in member 92.

Figure 10:
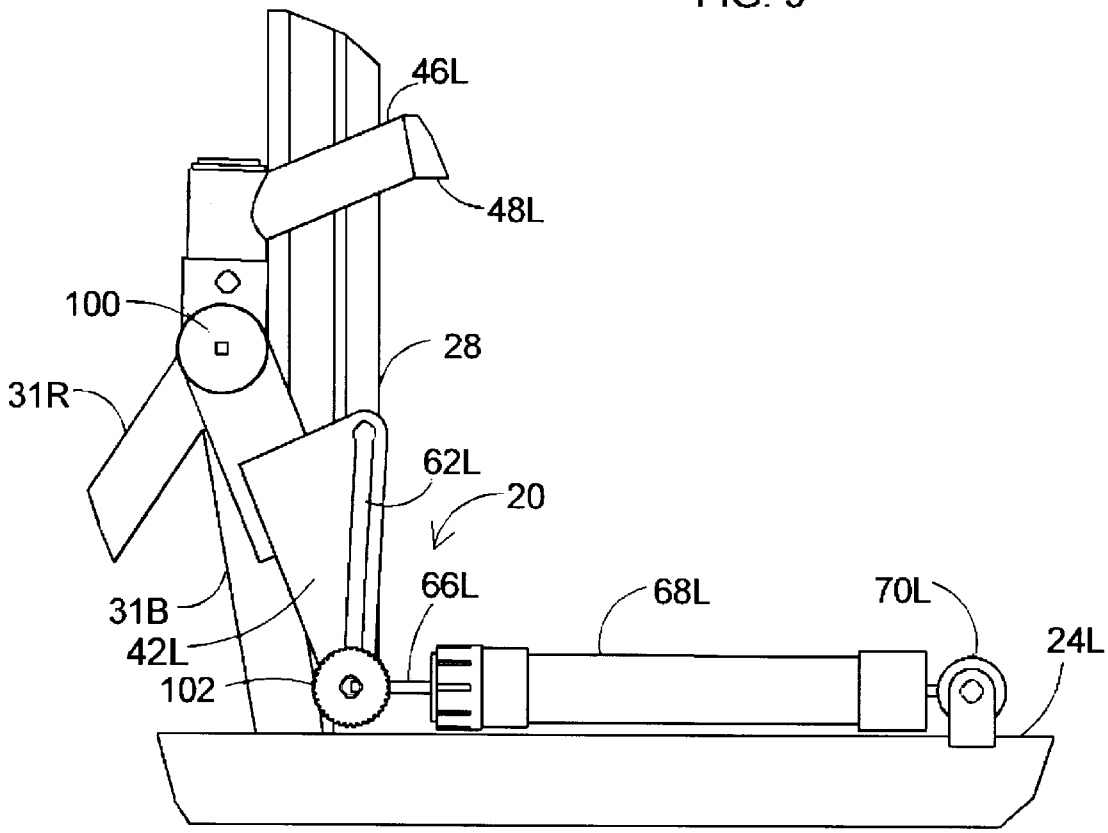
FIG. 10 is a broken out, side elevational view of the linkage mechanism (one opposing lateral sidewall) for the platform to frame interconnection with the lower support frame, depicting, in greater detail, the hydraulic piston rod linkage oriented to control the device action while in the operating mode of FIGS. 1 and 2.

In the broken-out, side elevational view of FIG. 10, the opposing lateral side of the device 20 when located in the mode of FIGS. 1–2, is seen enlarged for clarity of view of its linkage mechanism. The longitudinal orientation of lever arms, 46L/48L, are as depicted in either of FIGS. 1 and/or 2. With knurled knob 100 (to be described) adapted to maintain the one or the other longitudinal orientation of the lever arms during their use. Also during the stepping mode, piston rod 66L must be held at the lower end of linear slot 62L of vertical side plate, which alternate position is maintained by tightening knurled knob 102 (configured much like knob 88). The convenience of the described mating of lever arm to the post is to automatically set the arm in the optimum setting for either of the two primary modes of exercise described above.

Figure 11:
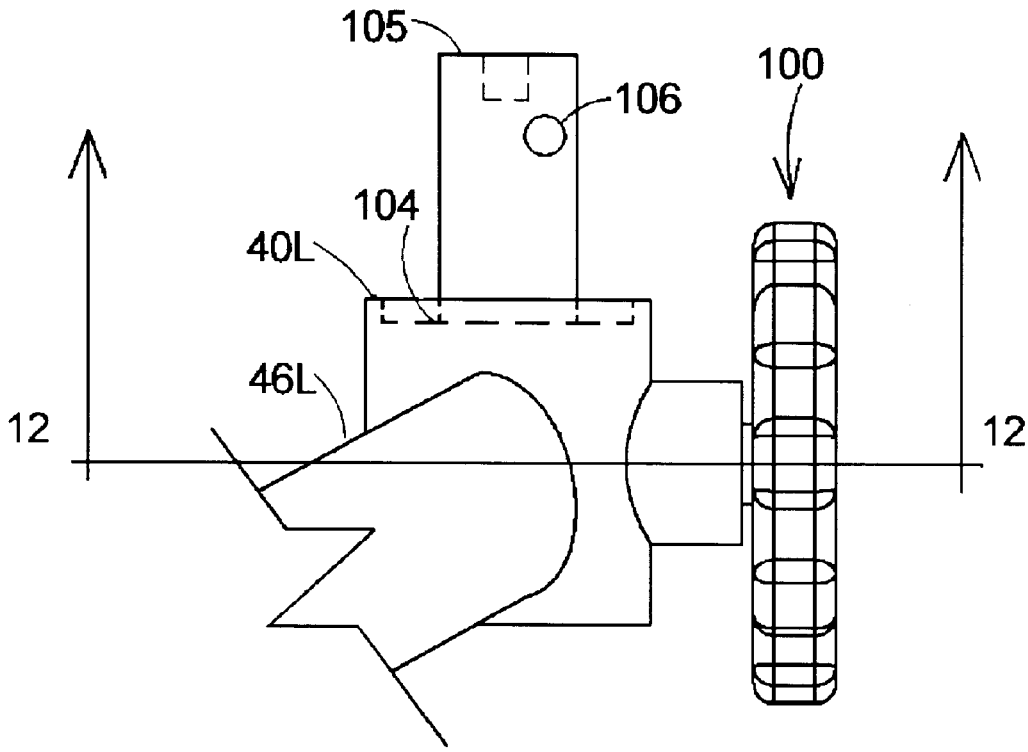
FIG. 11 is a broken-away, schematic view of the rotatable axis for the platform support frame with an associated lock-in-position knob; and, FIG. 12 is a vertical sectional view of the axial joint of FIG. 11, taken along lines 12—12 thereof.
Figure 12:
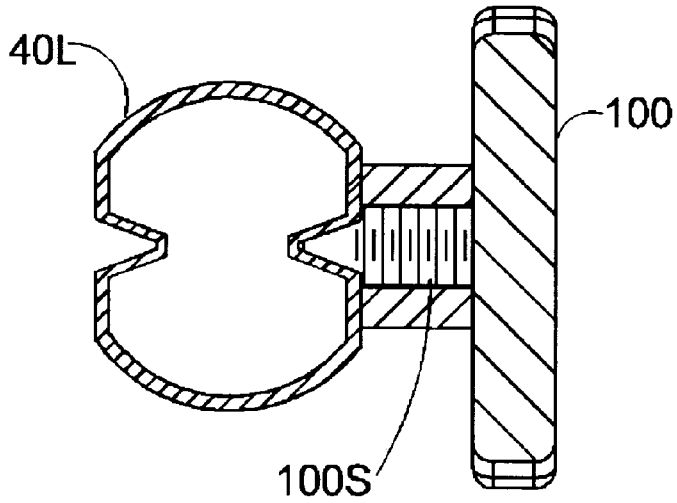

The mode of pivoting of the lever arms, 46L/48L, within top-recessed post 40L is better seen in the broken-out, perspective view of FIG. 11. Inserted Shaft 105 has a peripheral rounded recess 106 for lock-on of a lever arm. Post 40L has a central bore 104, which will admit of the rod-like, vertical shaft 105 of the lever arms base. When the lever arm shaft is seated in the bore 104, being in either of the two operating positions described earlier, the knob 100 is tightened up to hold the lever arm shaft in the intended orientation. The tapered inner end of the threaded shaft 100S, is seen in the vertical sectional view of FIG. 12.

Figure 13:
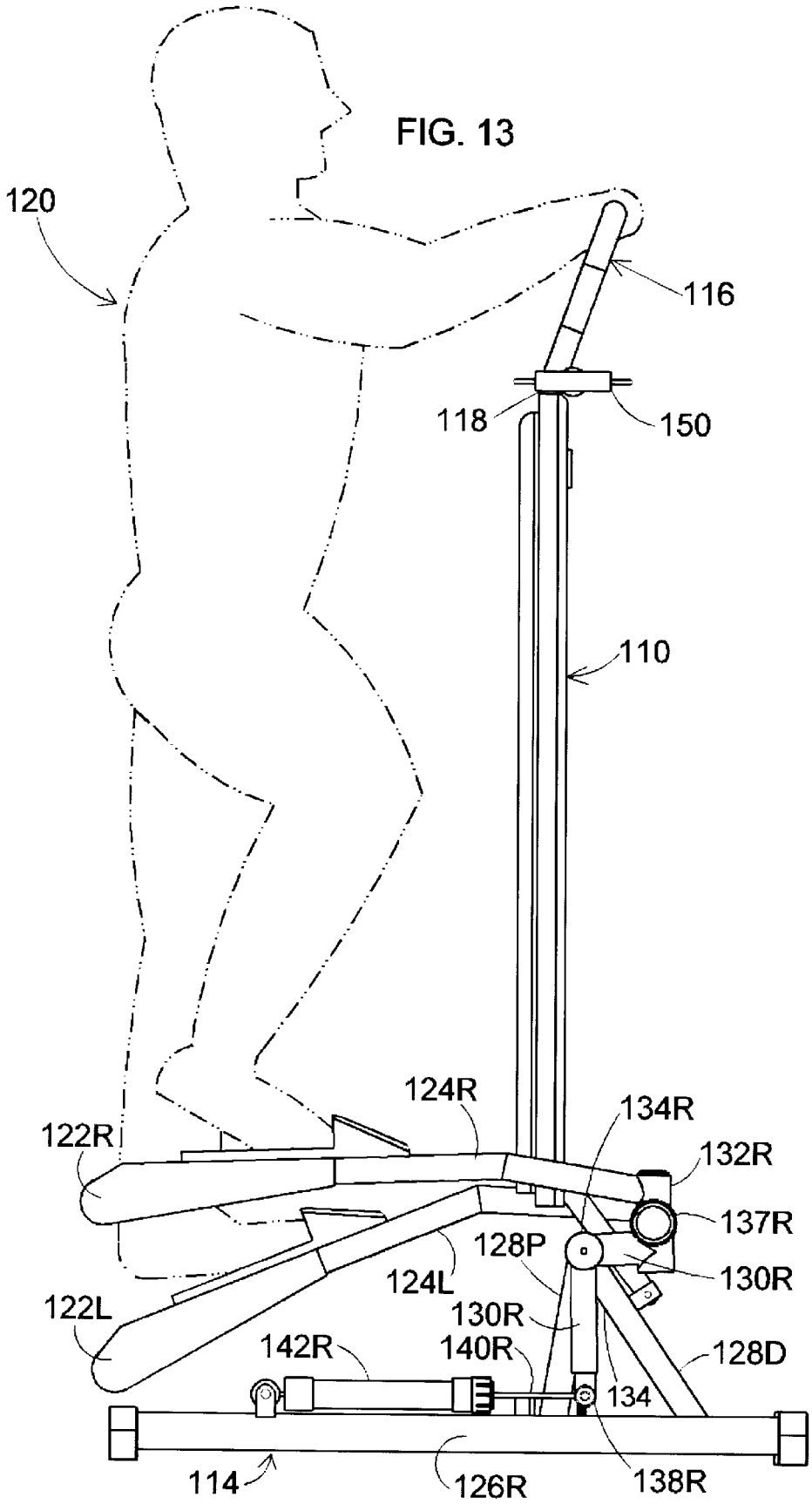
FIG. 13 is a side elevational view of an alternate embodiment of the foot stepping device, wherein the platform component is differently connected to the pivoting axis and an elbow-shaped lever arm interconnects at one end with the limb contacting member and its other end with an associated biasing means for providing variation in the degree of physical exertion needed to operate the device.

The side elevational view of FIG. 13 is directed to an alternate embodiment of the combination exercise device of FIG. 2, wherein the slotted support members, 62R/L, for anchoring the floating piston 62R and of viscous dampers 68L/R (FIG. 2), are functionally replaced by specially configured, laterally located lever arms. Foot stepping device 110 is seen with the platform member 112 thereof in the upright position, which member is adapted to extend between the H-frame 114, being at one end pivotally mounted thereon, and, at the other end, the open frame member 116 which straddles the transverse upper edge 118 of platform member 112. Open frame member 116 presents a hand-grippable, first component (34 in FIG. 1), disposed at the upper longitudinal end of the device 110. As depicted by the phantom user 120, it permits user stability while the platform elements, 122L/R, are receiprocally moving; such elements being located at the outer ends of hinged support arms 124L/R, which are being actuated reciprocally by the user. The floor contacting H-frame 114 of this embodiment, is essentially identical to the floor stationary component 22 depicted in FIG. 1.

Figure 14:
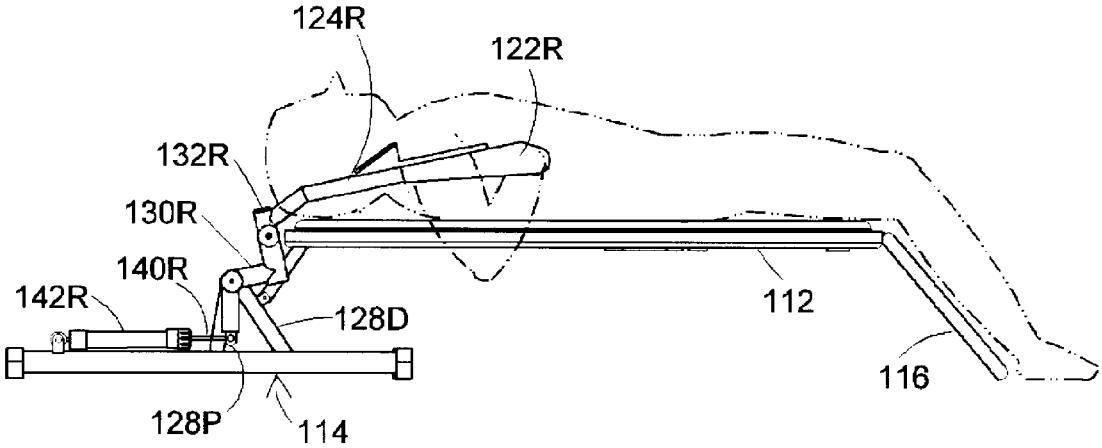
FIG. 14 is a side elevational view of the alternate embodiment of FIG. 13, but now configured in the bench pressing mode, and now having an elbow-shaped lever arm which interconnects at one end to the limb contacting member and its other end with associated biasing means for varied force in the degree of arm lifting efforts needed to operate the device.

The two spaced apart, transverse members 126L/R are the mounting points for right side paired upright members 128P/D of FIG. 14. Inclined uprights 128P/D being joined at their upper ends, provide the pedestals on which are pinned the pivotable levers, 130R/L, also vertically oriented for anchoring of the support arms, 124L/R, of the foot stepping platforms, 122L/R. Pivot levers 130L/R have a second axis of rotation, 132R/L (horizontal), adapted for shifting of the rotatable fixtures, 122L/R, to the other mode of operation of FIG. 14.

The elbow shaped lever members, 130L/R are axially pinned at the apex 134 of upright members 128P/D. At the upper longitudinal end of lever member, 132R, there is a central bore (not seen) that receives a journal-type element of support arm 124R, which provides for horizontal rotation of the support arms (124L/R) when required to switch operating modes. Thus, component 132R receives and retains (knob 137R) the inner end of support member 124R (thus supporting foot platforms). At the other (lower) end of lever 130R is its pivotal interconnection point 138R, with the push rod, 140R, of the one-side of paired viscous fluid dampers 142L/R. The distal longitudinal end of damper 142R is pivotally pinned to lateral support member 126R of H-frame 114 at mounted clevis 144R.

As the foot platform 122R is depressed by user leg action, the elbow shaped, lever members, 130L/R, rotate on its then vertical axis against the resistance of dampers 142L/R, effecting the desired counterforce to the user leg action. This mode obviates the need for prelocking of the damper piston rod 66R to that seen at the lower end of vertical slot 62R of the first embodiment of FIG. 2.

The alternate mode of operation of the device of FIG. 14 is presented in the side elevational view of FIG. 14, with torso platform 112 now being horizontal, and the open frame member 116 of FIG. 13, now serving as the distal end support for the bench platform 112. The foot platform support member, 122R and 122L, have been rotated horizontally on their axes 132R/L, so that the outer end, hand-grippable, transverse bars, 60L/R, of FIG. 5, can be engaged by the user hands. These bars, 60L/R are best seen in the other unfettered perspective view of FIG. 6, while the user is employing hand rings, 73L/R, and their tensioning cords 80L/R.

As there are no slotted member 62L/R (FIG. 2) needed in this embodiment, it is the hand activated, arcuate motion of the rotatable fixtures, 122L/R, linked through elbow-shaped lever members, 130L/R, to the free ends of push rods, 140L/R, associated with laterally aligned dampers 142L/R, with the latter providing the counter resistance to user exertions that provides the adjusted resistance to arm extentions.

In sum, only two adjustments are needed from the device posture seen in FIG. 13, to convert same to the bench press mode of FIG. 14. First rotate torso platform 112 (downwardly) to engage the supporting floor, as seen in the transitional view of FIG. 16, then rotate horizontally the support arms 122L/R to represent the hand grippable bars (60L/R) now positioned laterally and adjacent to the prone user. The rotatable members may now be lifted in unison by user experiencing the counter force of the underlying and mechanically linked dampers, 142L/R.

The broken away enlarged fragmentary view of FIG. 15 shows the action linkage mechanisms in detail, broken away from the mounting posts. Member 124S indicates the support arm orientation in the stepping mode, while hantom member 124B indicates the support arm orientation in the bench press mode.

The broken out perspective view of FIG. 16 (opposing lateral side) provides another depiction of the leverage linkages between the rotable support members, 124L/R, after the bench 112 itself which has been swung over the horizontal position (FIG. 14). This is just before such members are rotated horizontally (180°) to the operative bench pressing mode of FIG. 14. Note also the slanted pair of rigid legs 144L/R which link the bench transverse end 146P to the upstanding, triangular posts, 128D/P on the depicted lateral side of the device.

With regard to the D-ring subcombination of FIG. 8, it is practical to relocate the laterally-placed paired D-ring accessory to a portion other than that depicted in a midway setting. For example, they may be placed adjacent to the distal end 28 of the prone bench 112, and may still be operated from a pulley-driven tensioning device (FIG. 8) located beneath that bench. One such suitable system is similarly anchored to the variable resistance position, tensioning device 92 described for FIG. 8.

It is an anatomical feature that the weight of a person, coupled with the added fact that a typical user has naturally greater legs strength than one has upper torso strength, is a given. Consequently, the presently disclosed leverage system of FIG. 13–14 is now adapted to that physical fact, and thereby the alternate leveraging linkage of FIGS. 13/14 can accomodate the varied strength between upper limb and lower body members. This modification eliminates the need for slotted adjustment of the damper push rod anchoring point, as is depicted for the first embodiment between that of the foot stepper mode (FIG. 2) and that of the bench press mode (FIG. 4).

In Operation

With the stepping mode of FIG. 1, the platformed longitudinal ends 54L and 54R are fixedly secured to the spaced-apart, vertical horizontal support bars 48L and 48R. Such lever bars at their distal longitudinal ends are pivotally supported by offset, vertical posts 40L and 40R, and are adapted to rotate arcuately and reciprocally, as the user exerts downward force alternately on the step platforms. This occurs all while maintaining his vertical balance through hand gripping of the padded side bars, 36L/36R, adjacent the mast component 28. Note the free piston 66R end is fastened at the lower end of vertical slot 62R.

While in the stepping mode, the exerciser presses down on either of the foot platforms, 54L/54R, in FIG. 1, with the downward arcuate motion of the supporting lever arm 48L causing the horizontal upright members 48L/R to rotate arcuately. This activates the crank-arms, 40L/R, which draws on the piston rods 66L/R of resistance cylinders 68L/R, providing an adjustable counter-resistance, thus providing the needed mechanical resistance to the user's leg muscle exertions. Release of the downward human exertion, returns the stepped platform to the balanced posture (FIG. 1), under the internal bias of the two independently-acuated, hermetically-sealed cylinders.

While in the bench press mode, the underside, spaced-apart, hand gripping bars, 60L/R, of the platformed arms, 54L/R, are subjected by the user (curl gripping) to an uplifting pressure. This upwardly-directed arm exertion is constrained by the extending of the piston rods of the resisting cylinder, by a rotating of each pivotal vertical support bar. This provides the beneficial uniform resistance to the user's arm exertion efforts. The mechanical resistance occurs only on the uplift; and upon release, the grippable lever arms, 48L/R return to the at rest position, depicted in FIG. 3.

In this mode, by the pre-shift of the connection points 66L/R of the cylinder rods to the upper level of slots 62L/R, then the lever arms (48L/R) gain a mechanical advantage, as compared to that inherent in the lower connection points of the stepper mode depicted in FIGS. 1 and 2.

In another embodiment, which is a modest variation of the depicted device of FIG. 2, i.e., or while in the slanted board mode, the collapsible leg underneath the bench folds up to create a descending bench for stomach strengthening exercises, with the recessed handles for the stepper mode then serving as the necessary foot holders during the inclined board sit-up exercises.

For the varied uses of hand rings 73L/R, the scope of arm exericses is best shown in the schematics of FIGS. 7A–F, with the particular exercises underway being identified earlier. The degree of counter tension upon the hand rings is also preset by the position of the internal ends of cords 80L/R, docked in a slot like 90B, and retained during varying cord tension by knob 86R.

I claim:

1. A foot-stepping exercise device comprising a hand grippable first component disposed at one longitudinal end of the device and a second floor contacting component disposed proximal to the other longitudinal end thereof and consisting essentially of:

a. an elongate, generally rectangular platform member adapted to extend between and conjoin the first component and the second component, and being rotatably pinned to the second component and which platform is substantially vertically inclined so as to confront the standing erect device user;

b. the hand grippable first component comprises a generally rectangular rigid component anchored transversely at the first longitudinal end of the platform member and with its plane also disposed at an outward angle relative thereto, so that the first component projects outwardly of the plane of the platform member;

c. the second floor contacting component which comprises a generally H-shaped rigid frame composed of a first and second substantially parallel elongate elements and at least one transversely interconnecting first linear element, with all three elements underlying and supporting the platform member;

d. a second linear member disposed transversely between the first and second elongate members and located longitudinally offset from the first linear member;

e. a pair of spaced apart, upright posts suspended from and located along opposing sides of the elongate elements of the platform component, with each post also being located proximal to the outer longitudinal ends of the third second linear member element and with each post adapted to pivot about a horizontal axis;

f. a pair of lever members, with each member pivotally pinned at one longitudinal end to the upper longitudinal end of its respective upright post, with the lever arm, adapted to project the free lever arm ends variably vertically and arcuately along the device longitudinal sides;

g. a pair of limb contactable, rotatable fixtures, each fixture axially and pivotally pinned to the outer free ends of its respective lever member, with each rotatable fixture presenting a generally planar stepping element on one surface, and having an hand grippable bar on an opposing surface; and, h. a pair of biasing means for the lever members, parallel and spaced apart, with each of the biasing means pivotally anchored between one of the elongate elements of the floor supporting H-frame, and concurrently linked to the lower longitudinal end of its associated pivotable upright post, also with each of the biasing means adapted to offer mechanical resistance to the arcuate movement in reciprocal directions of the planar stepping element of the associated rotatable fixture, and with each biasing means moving in response to the foot stepping efforts imposed by the device user upon the rotatable fixture supported by the associated pivoting lever member.

2. A combined bench press and D-ring extension device comprising a first floor contacting component located at one longitudinal end of the device and a second floor contacting component proximal to the other longitudinal end of the device consisting essentially of:

a. an elongate, generally rectangular platform component adapted to extend between and be supported by the first and the second floor contacting components, the two platform components being adapted for user torso support while disposed in horizontal position;

b. a first floor contacting member comprising a generally H-shaped rigid frame comprised of a first and second parallel elongate elements and at least one transversely interconnecting first linear element with all three elements underlying and supporting the elongate platform component, with the first member being located proximal to a first longitudinal end of the platform component;

c. the second floor contacting member comprising a generally rectangular rigid component anchored transversely to the second platform component other longitudinal end, and being disposed at an outward angle therewith, so that its outermost opposing side form the second floor contacting elements thereof;

d. a second linear element disposed transverely between the first and second elongate members and located longitudinally offset from the first linear element;

e. a pair of spaced apart, upright posts suspended from and pivotally located along the proximal elongate elements with each post being adapted to pivot about a horizontal axis proximal to the outer longitudinal ends of the second linear element disposed transversely and beneath the platform component, with the second linear element being supported by the H-frame of the first floor contacting members;

f. a pair of lever members, each being pivotally pinned at one longitudinal end to the upper segment end of its respective upright post, with the lever arm adapted to project the free lever arm ends of the members vertically and arcuately of the platform components;

g. a pair of limb contactable fixtures, each fixture axially and pivotally pinned to the other free ends of their respective lever member, with each rotatable fixture presenting a generally planar stepping element on one surface and an alternate hand gripping bar on an opposing surface; and, h. a pair of biasing means for the lever members, parallel and spaced apart, with each biasing of the means pivotally anchored between one of the elongate elements of the floor supporting H-frame and concurrently linked to the lower longitudinal end of its associated upright post, also with each of the biasing means adapted to offer mechanical resistance to the arcuate movement of its associated lever member as induced by the arm lifting efforts of the device user upon the pair of hand grippable bars.

3. The pair of biasing means of claim 1 each comprising:

a. a first hydraulic cylinder having a supported reciprocating rigid rod projecting in a directionally biased manner, being located substantially parallel between the first of the elongate elements of the H-frame and its associated upright post, with free end of the rod operatively engaging the lower longitudinal end of its associated first lever post member, and the opposing end of the first supporting cylinder pivotally connected to the associated first elongate element member proximal to one longitudinal end; and b. a second functionally equivalent, hydraulic cylinder similiarly aligned on the second elongate element, and a supported rigid rod located substantially parallel to both the second elongate element of the H-frame and to the first lever member, being similarly operatively engaging the second member at its lower longitudinal end of its associated and the opposing supporting end of the second pivotally connected to the associated the second elongate element proximal to one distal longitudinal end.

4. The device of claim 1 wherein each of the shorter upright posts are further provided with an integral sidewall component that includes a vertically aligned, generally linear slot, that is slidingly linked to the free end of its associated rigid cylinder rod.

5. The device of claim 4 wherein each of the upright posts is further provided with a an integral planar sidewall component that includes a vertically aligned, generally linear slot, that is slidingly linked to the free end of its associated rigid rod by a displacable interlock assembly.

6. The device of claim 1 wherein during the foot stepping mode of device operation, the free end of the reciprocating rigid rod of each hydraulic cylinder is pinned to the lower longitudinal end of the supporting sidewall component linear slot during such exercise.

7. The device of claim 2 wherein during the bench pressing mode of operation, the free end of the reciprocating rigid rod of each hydraulic cylinder is pinned to the upper longitudinal end of the sidewall component linear slot during such exercise.

8. The device of claim 2 wherein a pair of hand rings and attached bungee cords are functionally located intermediate of the ends of the elongate lateral edges of the platform component, and each ring being provided with a reel-in system for its associated bungee cord, which cord is adapted and inherently biased so as to provide increasing mechanical resistance as the bench prone user exerts manual force on the paired hand rings outwardly of the platform component.

9. The bench press device of claim 2 wherein each of the upright posts at their lower longitudinal ends includes a planar sidewall component having a vertically aligned, generally linear slot that is slidingly linked to the associated piston rod and at the posts upper longitudinal ends, each includes an rounded pin adapted for lockingly engaging the inner free end of the associated lever arms, and the end of each post has a peripheral recess adapted to receive and retain the shaft of a locking upstanding pin.

10. The device of claim 8 wherein the pair of hand rings and the associated reel-in system comprises for each ring an elongatable bungee cord connected at one longitudinal end thereof to the apex of its associated ring and running from being proximal to the distal longitudinal end of the platform member underside to a point proximal to the other longitudinal end of the platform member, wherein the bungee cords are anchored at their distal ends to a retaining plate that has a linear bracket providing a reciprocating track of motion, having several intermediate arrest positions, which positions provide varying degrees of inherent tensioning in the associated bungee cord.

11. A foot-stepping exercise device comprising a hand grippable first component disposed at one longitudinal end of the device and a floor contacting second component disposed proximal to the other longitudinal end thereof and consisting essentially of:

a. an elongate, generally rectangular platform member adapted to extend between and conjoin the first component and the second component, and being rotatably pinned to the second component and which platform is substantially vertically inclined so as to confront the standing erect device user;

b. the hand grippable first component comprises a generally rectangular rigid component anchored transversely at the first longitudinal end of the platform member with its plane also disposed at an outward angle relative thereto, so that the first component projects outwardly of the plane of the platform member;

c. the floor contacting second component which comprises a generally H-shaped rigid frame composed of a substantially parallel first and second elongate elements and at least one transversely interconnecting first linear element, with all three conjoined elements underlying and supporting the platform member;

d. a pair of spaced apart, upright posts mounted fixedly at their lower longitudinal ends to one of the linear members with a central bore located at each free post upper end and which bore is adapted for pivotal support of any adjacent lever member;

e. a pair of spaced-apart, elbow-shaped, lever members, with each member suspended from and located functionally adjacent the supporting bores of their respective upright posts, and each such line minter being adapated to pivot vertically in the plane of the lateral sides of the platform member;

f. a first pair of elongated lever members, each being pivotally pinned at one longitudinal end to the upper segment end of its respective upright post at a first pivot point located thereon, with the lever arm adapted to project the free arm ends of the lever members vertically and arcuately of the platform components;

g. a pair of limb contactable, rotatable fixtures, each fixture axially and pivotally pinned to the outer free ends of its respective elongate lever member, with each rotatable fixture presenting a generally planar stepping element on one surface, and having an hand grippable bar on an opposing surface; and, h. a pair of biasing means for the operation of the elbow-shaped lever members, located parallel and spaced apart, with each of the biasing means pivotally anchored at one longitudinal end to one of the elongate elements of the floor supporting H-frame, and concurrently linked at the other longitudinal end to the lower longitudinal end of its associated pivotable elbow-shaped lever member, also with each of the biasing means adapted to offer mechanical resistance to the arcuate movement in reciprocal directions of the planar stepping element of the associated rotatable fixture, and with each biasing means moving arcuately in response to the foot stepping efforts imposed by the device user upon the rotatable fixture supported by the associated elongated lever member.

12. A bench press device comprising a first floor contacting component located at one longitudinal end of the device and a floor contacting second component proximal to the other longitudinal end of the device consisting essentially of:

a. an elongate, generally rectangular platform component adapted to extend between and be supported by the first and the second floor contacting components, the two platform component being adapted for user torso support while disposed in horizontal position;

b. a floor contacting first member comprising a generally H-shaped rigid frame comprised of a first and second parallel elongate elements and at least one transversely interconnecting first linear element with all three elements underlying and supporting the elongate platform component, with the first member being located proximal to a first longitudinal end of the platform component;

c. the floor contacting second member comprising a generally rectangular rigid component anchored transversely to the second platform component at the other longitudinal end, so that its outermost opposing side form the second floor contacting elements thereof;

d. a first pair of spaced-apart, substantially vertical upright posts, mounted fixedly at their lower longitudinal ends to one of the two linear members provided with a central bore located at each free post upper longitudinal end which bore is adapted for pivotal support of any adjacent lever member;

e. a first pair of spaced-apart, elbow-shaped lever members suspended from and located functionally adjacent the supporting bores of their respective vertical upright posts and each such lever member being adapted to pivot vertically and reciprocally in the plane of the lateral sides of the platform member;

f. a first pair of elongated lever members, each being pivotally pinned at one longitudinal end to the upper segment end of its respective upright post at a first pivot point located thereon, with the lever arm adapted to project the free arm ends of the lever members vertically and arcuately of the platform components;

g. a pair of limb contactable, rotatable fixtures, each fixture axially and pivotally pinned to the outer free ends of its respective elongate member, with each rotatable fixture presenting a generally planar stepping element on one surface, and having a hand grippable bar on an opposing surface; and, h. a pair of biasing means for the operation of the elbow-shaped lever members, located parallel and spaced apart, with each of such biasing means pivotally anchored at one longitudinal end to the elongate elements of the floor supporting H-frame, and concurrently linked at the other longitudinal end to the lower longitudinal end of its associated pivotable elbow-shaped lever member, also with each of the biasing means adapted to offer mechanical resistance to the arcuate movement in reciprocal directions of hand grippable bars of the associated rotatable fixture, and with each biasing means moving arcuately in response to the bench pressing efforts imposed by the device user upon the rotatable fixture supported by the associated pivoting elongate lever member.

13. The exercise device of claim 11 wherein there is provided a second linear member disposed transversely between the first and second elongate members and located longitudinally offset from the first linear member.

14. The exercise device of claim 12 wherein there is provided a second linear element disposed transversely between the first and second elongate members and located longitudinally offset from the first linear element.

* * * * *